United States Patent [19]

Robichaud

[11] Patent Number: 4,868,943

[45] Date of Patent: Sep. 26, 1989

[54] COMBINATION TOOL FOR WALLBOARD AND INSULATION APPLICATIONS

[76] Inventor: Allen J. Robichaud, Old Stratton La., Stillwater, N.Y. 12170

[21] Appl. No.: 217,214

[22] Filed: Jul. 11, 1988

[51] Int. Cl.[4] ..... B25F 1/00

[52] U.S. Cl. ..... 7/166; 269/904; 254/131; 52/127.2; 248/354.5; 248/357

[58] Field of Search ..... 7/166, 170; 269/904; 254/120, 131; 52/127.2, 632; 248/354.5, 357, 558

[56] References Cited

U.S. PATENT DOCUMENTS

| | | | |
|---|---|---|---|
| 2,989,286 | 6/1961 | Gillespie | 254/131 |
| 3,524,239 | 8/1970 | Lewis | 269/904 |
| 4,314,429 | 2/1982 | Casteel et al. | 52/127 |
| 4,576,354 | 3/1986 | Blessing, Sr. | 248/354.8 |
| 4,712,771 | 12/1987 | Donnelly et al. | 254/131 |
| 4,752,057 | 6/1988 | Hagemes | 248/354.5 |

*Primary Examiner*—Roscoe V. Parker

*Attorney, Agent, or Firm*—Schmeiser, Morelle & Watts

[57] ABSTRACT

A combination tool for the installation of wallboard and the application of insulation to a building. The tool comprises an elongate, rectangular, tublar rod having a kickjack at one end and an extender, which is attachable to the kickjack and is used for adjusting the length of the tool. The tool performs two functions as a wallboard installation device. First, a blade at the free end of the kickjack is used for supporting wallboard as it is being positioned and secured to a building frame, thereby freeing the construction worker's hands so that only one worker is required to hang a piece of wallboard. Second, the tool is useful as a "kickjack" or lever-fulcrum combination to install a wallboard at floor level tightly against an upper level wallboard. The combination tool also has a tined attachment, which can be fixed to the blade, for applying insulation to a building frame.

4 Claims, 2 Drawing Sheets

COMBINATION TOOL FOR WALLBOARD AND INSULATION APPLICATIONS

FIELD OF THE INVENTION

The present invention relates generally to tools for use in the construction of buildings. More particularly, this invention is a combination tool for installing wallboard and for applying insulation to a building.

BACKGROUND OF THE INVENTION

At present, no tool is readily available for supporting and positioning a wallboard as it is being installed to a building frame above floor level in a vertical position. It is common practice, therefore, for one construction worker to hold the wallboard in a secure, abutting relationship to an adjacent wallboard as another secures it by nailing it to the structure. The procedure thus employed is inefficient in that one worker could accomplish the entire task of installation, thus freeing the other to perform additional tasks.

With a wallboard vertically in place on the upper portion of a wall of the building frame, a tool commonly referred to as a "kickjack" is used to install a wallboard at floor level tightly against the upper wallboard. The kickjack comprises a lever and fulcrum with a blade at one end of the lever for supporting an edge of the wallboard. The user inserts the blade under the bottom edge of the wallboard and steps on the raised edge of the lever in order to position the lower level wallboard tightly against the upper piece. The present inventor has combined the features of the kickjack with a new tool for positioning and supporting wallboard in a vertical position. Thus, a versatile tool has been developed which may be easily, conveniently, and efficiently used by a single construction worker to install both upper and lower pieces of wallboard.

Still another tool found lacking in the construction field is a device for installing friction-fit insulation, i.e. insulation without foil or paper backing. Handling such insulation can be both uncomfortable and dangerous to the construction worker because of its glass composition. Presently, workers generally wear gloves to handle such materials.

The present inventor has, thus, further incorporated into this combination tool an attachment for converting the wallboard hanger into a tool for applying insulation to a building structure. The attachment comprises a tined device which is easily attachable to the blade of the tool.

The major advantages of the invention are set forth in part herein and in part will be obvious herefrom or may be learned by practice with the invention, the same being realized and attained by means of the instrumentalities and combinations pointed out in the appended claims.

SUMMARY OF THE INVENTION

The present invention is a combination tool for installing wallboard and for applying insulation to a building. The tool comprises an elongate, tubular rod having a kickjack and an extender, which is removably attachable to the kickjack. The kickjack has a flat blade at one end for holding wallboard as it is being positioned and secured to a building frame. Thus, only one construction worker is required to hang a piece of wallboard. An attachment to the blade, a tined device or fork, converts the tool from a wallboard hanger to an insulation application tool.

As a wallboard installation tool, the present invention has two distinct functions. First, it is useful as a support for holding wallboard in a steady position abutting an adjacent wallboard as the construction worker secures it to the building frame. When used in this capacity, angled rubber edging at the bottom of the extender prevents the rod from slipping. Second, the tool comprises a kickjack of variable length. A fulcrum on the kickjack portion of the tool enables the user to place a lower piece of wallboard at floor level into a tight abutting relationship with the adjacent upper piece of wallboard. With one edge of the wallboard being supported by the blade, the user merely steps on the raised portion of the jack, thereby raising the wallboard in order to establish a close-fitting relationship between both pieces of the wallboard.

To convert the wallboard installation tool into an insulation applicator, a tined device is removably attached to the blade of the kickjack. The tines easily engage insulation of the type having no foil or paper backing so that handling of the same may be minimized.

The invention consists in the novel parts, constructions, combinations and improvements herein shown and described.

The accompanying drawings referred to herein and constituting a part hereof illustrate preferred embodiments of the invention and together with the description, serve to explain principles of the invention.

BRIEF DESCRIPTION OF THE DRAWINGS Of the Drawings.

DETAILED DESCRIPTION OF THE DRAWINGS

Figures 1, 2:
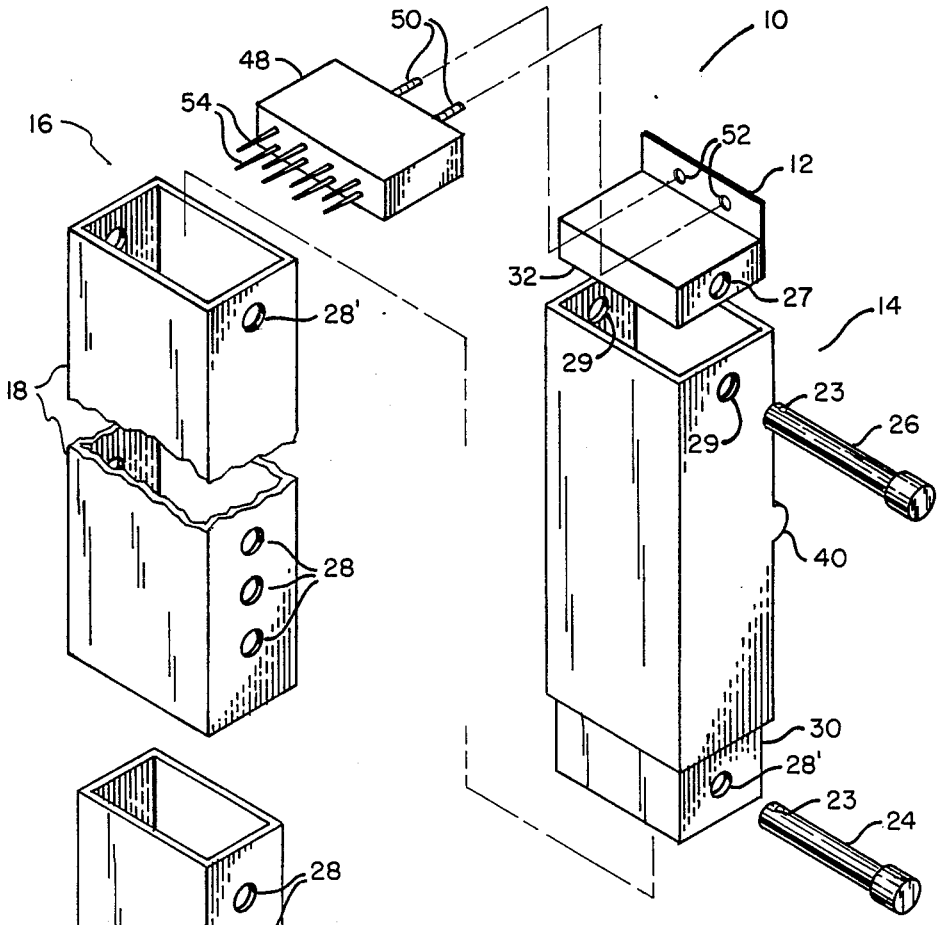
FIG. 1 is an exploded view of the kickjack portion of the combination tool of the present invention.
FIG. 2 is an exploded partial view of the present invention showing how the upper portion of the tool's extender engages the telescopic extension.

With reference to FIGS. 1 and 2, the combination tool for the installation of wallboard and the application of insulation is shown, generally designated by the numeral 10.

Relative to the use of the combination tool 10 as a wallboard installation device, there are three major components: the blade 12; the kickjack 14; and the extender 16, comprising the upper extendable portion 18 and the telescopic extension 20.

The three major components are secured together by means of pins 22, 24, 26 and pin-receiving holes 27, 28, 29. The pins are of the type having spring biased detent means 23 for temporarily locking portions of the tool 10 together upon insertion into the pin-receiving holes 28. Specifically, the kickjack 14 and the extender 16 are tubular, rectangular members. The end 30 of the kickjack 14, which is opposite the blade-receiving end, is of slightly smaller cross-section than the body of the kickjack 14 so that it may be inserted into the extender 16. The kickjack 14 is then secured to the extender 16 by inserting pin 24 into holes 28'. In an alternate embodiment (not shown), the kickjack 14 is of uniform cross-section; and a separate, tubular, rectangular support member is inserted into the ends to be joined of the tubular kickjack 14 and the extender 16, the three parts being secured together with pins.

The cross-section of the kickjack 14 and the upper extendable portion 18 are slightly larger than that of the extension 20, thus enabling the insertion of the extrusion 20 into the upper extendable portion 18. With the extension 20 inserted as described, the length of the tool 10 may be telescopically adjusted. This is accomplished by selecting an appropriate pin-receiving hole 28 in both the upper extendable portion 18 of the rod and the extension 20 in order to achieve the desired tool length and by then making the selected holes 28 coincide so that a pin 22 of the type above described may be inserted therein to secure the two portions of the rod together.

To attach the blade 12 to the tool 10, pin-receiving holes 27 in the rectangular, tubular blade support member 32 are aligned with pin-receiving holes 29 in the kickjack 14; two blade pins 26, only one of which is shown in FIG. 1, are then inserted therethrough.

Figure 3:
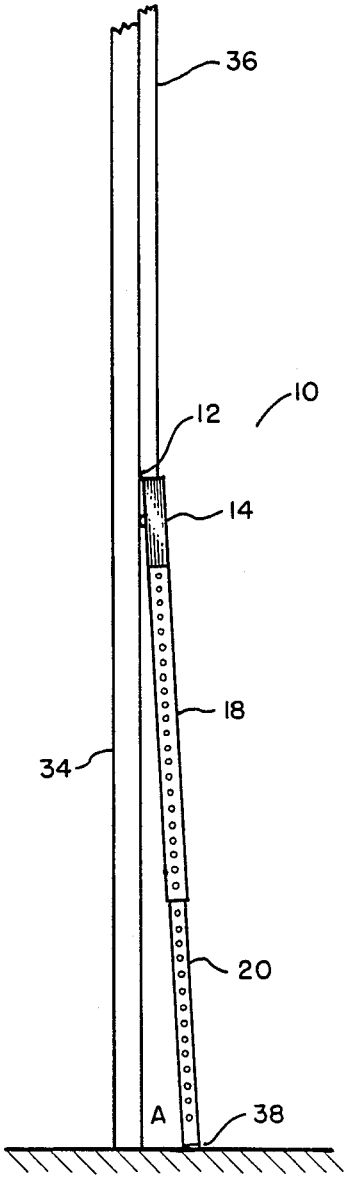
FIG. 3 is a perspective view showing the combination tool of the present invention being used as a wallboard support.
Figure 4:
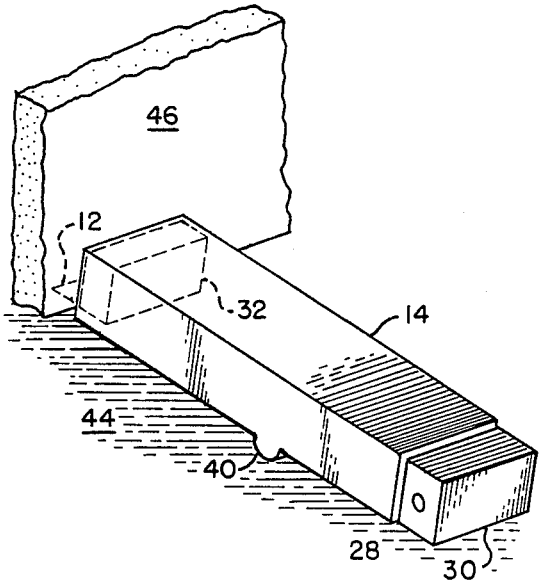
FIG. 4 is a perspective view showing the combination tool of the present invention being used as a kickjack for installing a wallboard at floor level.

The tool 10 performs two functions as a wallboard installation device. First, the tool 10 functions as a wallboard support, as shown in FIG. 3. In this capacity, the tool 10 is maintained in an extended position and at a slight angle A with respect to the wall 34 of the building frame. The wallboard 36 to be installed rests securely against the blade 12 as it is supported by the tool, thus freeing the hands of the construction worker who is then able to nail the wallboard 36 being supported to the building frame. The result is the installation of the wallboard 36 by a single person.

The angled non-slip edge 38 at the bottom of the extension 20 stabilizes the tool 10 through the force of friction when it is used as a wallboard support by preventing the slippage thereof. The non-slip edge 38 is preferably made of rubber, but any other material having a sufficient coefficient of friction, relative to the floor, may be used.

The second function of the present invention, as a wallboard installation device, is a "kickjack" or lever function. In particular, the kickjack 14 of the tool 10 comprises the blade 12 and blade support member 32 at one end and a fulcrum 40 toward its center. To use the tool as a kickjack, the extender 16, with or without the extension 20, may be removed from the kickjack 14 or not, depending upon the lever length needed. The blade 12 is inserted between the floor 44 and wallboard 46 to be installed so that the free end of the tool 10 is raised above the floor 44. The construction worker then applies pressure to the raised end, such as by stepping thereon. In so doing, the blade 12 of the tool 10 raises the wallboard 46 to place the wallboard 46 into a tight, abutting relationship with a piece of wallboard (not shown) which has previously been installed above the present installation.

The preferred embodiment of the present invention is a tool measuring fifty-two inches in length, fully extended, with a kickjack 14 measuring fifteen inches.

The combination tool 10 of the present invention also functions as an insulation application device. In particular, the tool 10 is useful for installing friction-fit insulation into a building frame. However, the tool 10 may be adapted to apply other types of insulation, such as foil of paper backed insulation. To use the tool 10 for the application of insulation, an auxiliary attachment in the form of a tined device 48 is mounted to the blade 12 by inserting the attachment bolts 50 into the blade attachment holes 52. Nuts (not shown) are used to secure the device 48 to the tool 10. Using the tines 54 of the device 48 to engage the insulation to be applied, the worker then merely uses the tool handle, which comprises the kickjack 14 and the extender 16, to securely position the insulation within the building frame. When used in this capacity, the tool 10 may be adjusted to the desired length, as hereinbefore discussed.

The invention in its broader aspects is not limited to the specific embodiments herein shown and described but departures may be made therefrom within the scope of the accompanying claims, without departing from the principles of the invention and without sacrificing its chief advantages.

What is claimed is:

1. A combination tool for positioning and supporting wallboard during its installation, which comprises an elongate rod of tubular construction, said rod further comprising an extender and a tubular kickjack adapted to receive said extender longitudinally therethrough, said kickjack having a flat blade at one end thereof, said blade being coextensive with one edge of said rod and forming an "L" shaped end thereby, said kickjack further comprising an integral fulcrum disposed proximate said blade end of said rod, whereby said rod is used to lever a wallboard which rests on said blade end into an abutting relationship with an adjacent wallboard which has been previously installed thereabove.

2. The tool of claim 1 wherein said flat blade further comprises means for accepting a tined device orthogonally thereto.

3. The tool of claim 2, further comprising friction means mounted to said extender's exposed end for preventing said rod from slipping when it is supporting a wallboard in an essentially vertical position.

4. A combination tool for positioning and supporting wallboard during its installation and for installing insulation, which comprises:

an elongate rod of tubular construction comprising an extender and a kickjack;

a flat blade at one end of said kickjack, said blade being longitudinally coextensive to one edge of said rod, said blade further having attachment means for removably fixing a tined device orthogonally thereto;

a tined device for engagement with said attaching means, the tines of said tined device being disposed orthogonally to said blade and adapted to engage insulation for the installation thereof;

an integral fulcrum mounted on said kickjack and disposed proximate said blade, whereby said rod is used to lever a wallboard into an abutting relationship with an adjacent wallboard which has been previously installed thereabove.

* * * * *